US007878358B2

(12) United States Patent
Smudde

(10) Patent No.: US 7,878,358 B2
(45) Date of Patent: Feb. 1, 2011

(54) MULTIPLE CONTAINER CART WITH INDIVIDUAL FOOT PEDAL/LID ACTUATION

(75) Inventor: Anton M. Smudde, Elk Grove Village, IL (US)

(73) Assignee: Covidien AG (CH)

( * ) Notice: Subject to any disclaimer, the term of this patent is extended or adjusted under 35 U.S.C. 154(b) by 1469 days.

(21) Appl. No.: 11/235,417

(22) Filed: Sep. 26, 2005

(65) Prior Publication Data

US 2007/0068942 A1 Mar. 29, 2007

(51) Int. Cl.
*B65D 21/024* (2006.01)

(52) U.S. Cl. ..... 220/23.88; 220/909; 220/23.4

(58) Field of Classification Search ..... 220/23.4, 220/23.86, 909, 23.88; 248/907, 95; 312/351, 312/211; 280/79.2, 79.3, 79.5
See application file for complete search history.

(56) References Cited

U.S. PATENT DOCUMENTS

| | | | | | |
|---|---|---|---|---|---|
| 313,592 | A | * | 3/1885 | Howe | 312/199 |
| 1,315,143 | A | * | 9/1919 | Masters | 217/57 |
| 2,351,597 | A | | 5/1942 | Burlin | |
| 2,667,320 | A | | 11/1952 | Whitley | |
| 2,634,933 | A | | 4/1953 | Grimsley | |
| 3,041,030 | A | | 6/1962 | Heimrich | |
| 3,064,931 | A | | 11/1962 | Rowe | |
| 3,208,706 | A | | 9/1965 | Clark | |
| 3,333,721 | A | | 8/1967 | Marek | |
| 3,347,507 | A | | 10/1967 | Dyer | |
| 3,869,979 | A | | 3/1975 | Sulcek | |
| 3,917,106 | A | * | 11/1975 | Bargetzi | 220/23.83 |
| 4,338,987 | A | | 7/1982 | Miles | |
| 4,420,168 | A | | 12/1983 | Dewing | |
| 4,637,545 | A | | 1/1987 | Stewart | |
| 4,765,548 | A | | 8/1988 | Sing | |
| 4,883,189 | A | | 11/1989 | Lobbert | |
| 4,911,294 | A | | 3/1990 | Russo et al. | |
| 4,984,704 | A | * | 1/1991 | O'Malley | 220/23.4 |
| 5,048,712 | A | | 9/1991 | Wolters | |
| 5,082,132 | A | | 1/1992 | Tsai | |

(Continued)

FOREIGN PATENT DOCUMENTS

DE 890623 9/1953

(Continued)

OTHER PUBLICATIONS (18 page Specification and 3 page Drawing figures) U.S. Appl. No. 11/234,630, filed Sep. 23, 2005.

(Continued)

*Primary Examiner*—Stephen Castellano
(74) *Attorney, Agent, or Firm*—Lisa E. Winsor, Esq.

(57) ABSTRACT

A refuse receptacle system comprising a frame and a plurality of refuse containers supported by the frame is provided. Each of the refuse containers have a receptacle and a complimentary lid reciprocally movable with respect to the receptacle. The receptacle of each of the containers is supported by the frame and is disposed at an angle in a range from about 10 to about 20 degrees from a vertical axis. A plurality of linkages are associated with the frame, whereby each linkage is coupled to the complimentary lid of one of the containers and is configured for reciprocation of the complementary lid between an open position and a closed position with respect to the receptacle.

22 Claims, 13 Drawing Sheets

U.S. PATENT DOCUMENTS

| | | | | |
|---|---|---|---|---|
| 5,107,990 | A | 4/1992 | Wicherski et al. | |
| D326,753 | S | 6/1992 | DeBusk | |
| 5,143,389 | A | 9/1992 | Jonkers | |
| 5,163,574 | A | 11/1992 | Sosan | |
| D332,852 | S | 1/1993 | Delmerico | |
| 5,195,649 | A | 3/1993 | Wolters | |
| 5,230,525 | A | 7/1993 | Delmerico et al. | |
| 5,235,795 | A | 8/1993 | DeBusk | |
| D341,237 | S | 11/1993 | DeBusk | |
| 5,348,222 | A | 9/1994 | Patey | |
| 5,354,023 | A | 10/1994 | Meeks | |
| D352,350 | S | 11/1994 | Rambo et al. | |
| 5,372,271 | A | 12/1994 | Miller et al. | |
| D358,240 | S | 5/1995 | Mosior | |
| 5,415,315 | A | 5/1995 | Ramirez | |
| 5,419,435 | A | 5/1995 | Perzan et al. | |
| 5,445,397 | A | 8/1995 | Evans | |
| 5,474,201 | A | 12/1995 | Liu | |
| 5,531,346 | A | 7/1996 | Mosior | |
| 5,531,348 | A | 7/1996 | Baker et al. | |
| 5,538,158 | A | 7/1996 | Prout et al. | |
| 5,570,547 | A | 11/1996 | Webb et al. | |
| 5,582,322 | A | 12/1996 | Prout et al. | |
| 5,590,840 | A | 1/1997 | Adams et al. | |
| 5,659,247 | A | 8/1997 | Clements | |
| 5,662,235 | A * | 9/1997 | Nieto | 220/23.86 |
| 5,671,859 | A | 9/1997 | Sheu et al. | |
| 5,673,811 | A | 10/1997 | Dickinson et al. | |
| D388,577 | S | 12/1997 | Rehrig et al. | |
| 5,706,971 | A * | 1/1998 | Taylor | 220/523 |
| 5,730,451 | A | 3/1998 | Walker | |
| D393,334 | S | 4/1998 | Presnell et al. | |
| 5,853,181 | A * | 12/1998 | Booras | 280/47.35 |
| 5,881,896 | A | 3/1999 | Presnell et al. | |
| 5,899,468 | A | 5/1999 | Apps et al. | |
| 5,947,285 | A | 9/1999 | Gaba et al. | |
| 6,010,024 | A | 1/2000 | Wang | |
| 6,053,354 | A | 4/2000 | Niemeyer | |
| 6,138,558 | A | 10/2000 | Harrington | |
| 6,202,922 | B1 | 3/2001 | Phillips et al. | |
| D445,228 | S | 7/2001 | Apps et al. | |
| D478,701 | S | 8/2003 | Panek, Jr. | |
| 6,623,316 | B1 | 9/2003 | Wu | |
| 6,626,316 | B2 | 9/2003 | Yang | |
| 6,626,321 | B2 | 9/2003 | Jaeger | |
| 6,651,992 | B1 | 11/2003 | Smith, Sr. | |
| 6,722,672 | B2 | 4/2004 | Cates et al. | |
| 2002/0158068 | A1 | 10/2002 | Panek, Jr. | |
| 2004/0020927 | A1 | 2/2004 | Yang et al. | |
| 2004/0142132 | A1 * | 7/2004 | Sandstrom et al. | 428/35.7 |
| 2006/0213910 | A1 * | 9/2006 | Yang et al. | 220/264 |

FOREIGN PATENT DOCUMENTS

| | | |
|---|---|---|
| DE | 71 24 285 | 9/1971 |
| DE | 43 30 245 | 12/1994 |
| DE | 100 47 534 | 4/2002 |
| JP | 07-257704 | 9/1995 |
| JP | 09-086602 | 3/1997 |

OTHER PUBLICATIONS (1 page Specification and 6 page Drawing figures) U.S. Appl. No. 29/238,362, filed Sep. 14, 2005.
(30 page Specification and 27 page Drawing figures) U.S. Appl. No. 11/085,488, filed Mar. 21, 2005.
(1 page Specification and 13 page Drawing figures) U.S. Appl. No. 29/239,042, filed Sep. 23, 2005.
Sharpsafety Brochure of Tyco Healthcare, dated Dec. 2000.
International Search Report for TCO1-105US dated Feb. 7, 2007.

* cited by examiner

MULTIPLE CONTAINER CART WITH INDIVIDUAL FOOT PEDAL/LID ACTUATION

FIELD OF THE INVENTION

The present invention relates to a medical waste storage and transport system.

BACKGROUND OF THE INVENTION

This invention relates generally to a waste collection system for use in a hospital or a similar environment where assorted waste items are collected and disposed of without creating a hazard for patients or hospital personnel.

In hospitals, clinics and similar medical institutions, contamination continues to be of utmost concern. Hazardous patient care products such as sharps, tongue depressors and collection vials are disposed of in an appropriate hazardous waste container. In addition to hazardous patient care products, non-hazardous matter, laundry and/or recyclable items are commonly collected or disposed of in separate and distinct containers. The separate containers may be scattered across the hospital which may present a challenge for a medical practitioner to locate a particular container. Such an arrangement could cause a medical practitioner to inadvertently or intentionally deposit waste items in the wrong container.

Waste collection systems having a plurality of individual containers in one location currently exist, such as the stackable refuse container system disclosed in U.S. Pat. No. 5,445,397. The '397 patent discloses a stackable refuse container system that includes multiple stackable containers, each of which may be designated for holding a particular recyclable material. The containers are vertically stacked and a cart can be provided for transporting the stacked assembly to and from a curb. Each container may include a removable lid, a front portion of the lid being hingedly attached to provide access to the container and a second portion formed to engage and support a bottom of a complementary container.

Nevertheless, there remains a need for improved refuse receptacle systems in general and methods for separately disposing medical waste of different types in respective containers.

SUMMARY OF THE INVENTION

In one exemplary embodiment, a refuse receptacle system comprising a frame and a plurality of refuse containers supported by the frame is provided. Each of the refuse containers has a receptacle and a complimentary lid reciprocally movable with respect to the receptacle. The receptacle of each of the containers is supported by the frame and disposed at an angle in a range from about 10 to about 20 degrees from a vertical axis. A plurality of linkages are associated with the frame, whereby each linkage is coupled to the complimentary lid of one of the containers and is configured for reciprocation of the complementary lid between an open position and a closed position with respect to the receptacle.

In another exemplary embodiment, a refuse receptacle assembly configured for use with a plurality of refuse containers, each having a receptacle and a complimentary lid, is provided. The refuse receptacle assembly comprises a frame configured to support the receptacle of each of the containers at an angle in a range from about 10 to about 20 degrees from a vertical axis. A plurality of linkages are associated with the frame, whereby each linkage is configured to be coupled to a complimentary lid of one of the containers and is configured for reciprocation of the complementary lid between an open position and a closed position with respect to the receptacle.

In yet another exemplary embodiment, a method is provided for separately disposing of medical waste of different types in respective containers. The method includes the step of actuating a first foot pedal of a frame assembly to open a lid of a first container, thereby providing access to an interior of a receptacle of the first container. A first type of medical waste is deposited in the receptacle of the first container. A second foot pedal of the frame assembly is actuated to open a lid of a second container, thereby providing access to an interior of a receptacle of the second container. A second type of medical waste is deposited in the receptacle of the second container.

In still another exemplary embodiment, a method of configuring a plurality of containers for disposing of medical waste of different types in respective containers is provided. The method includes the step of positioning a receptacle of each container on a frame assembly at an angle in a range from about 10 to about 20 degrees from a vertical axis. The lids of the containers are positioned on the frame assembly for pivotal movement with respect to the complementary receptacles, whereby the lids of the containers are each operable with respective foot pedals.

DETAILED DESCRIPTION OF THE INVENTION

Figure 1:
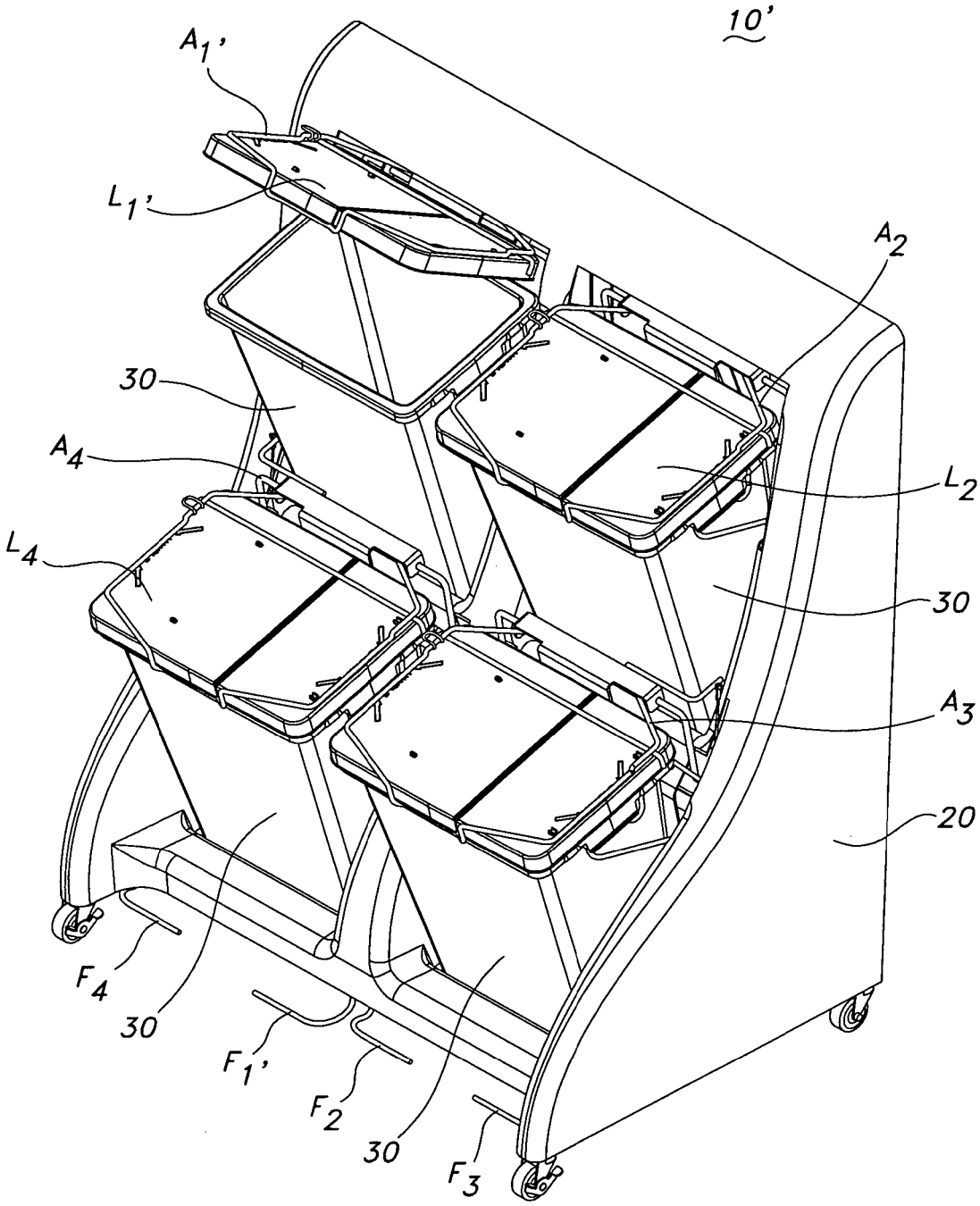
FIG. 1 is a perspective view from the top right of an exemplary embodiment of an assembly including a cart and four containers mounted thereon according to aspects of this invention.

Although the invention is illustrated and described herein with reference to specific embodiments, the invention is not intended to be limited to the details shown. Rather, various modifications may be made in the details within the scope and range of equivalents of the claims and without departing from the invention.

Referring generally to the figures, in one exemplary embodiment a refuse receptacle system 10, 10', 110 comprising a frame 20 and a plurality of refuse containers supported by the frame 20 is provided. Each of the refuse containers have a receptacle 30 and a complimentary lid $L_{1-4}$ reciprocally movable with respect to the receptacle 30. The receptacle 30 of each of the containers is supported by the frame 20 and is disposed at an angle N in a range from about 10 to about 20 degrees from a vertical axis. A plurality of linkages $K_{1-4}$ are associated with the frame 20, whereby each linkage $K_{1-4}$ is coupled to the complimentary lid $L_{1-4}$ of one of the containers and is configured for reciprocation of the complementary lid $L_{1-4}$ between an open position and a closed position with respect to the receptacle 30.

In another exemplary embodiment, a refuse receptacle assembly 10, 10', 110 configured for use with a plurality of refuse containers, each having a receptacle 30 and a complimentary lid $L_{1-4}$, is provided. The refuse receptacle assembly 10, 10', 110 comprises a frame 20 configured to support the receptacle 30 of each of the containers at an angle N in a range from about 10 to about 20 degrees from a vertical axis. A plurality of linkages $K_{1-4}$ are associated with the frame 20, whereby each linkage $K_{1-4}$ is configured to be coupled to a complimentary lid $L_{1-4}$ of one of the containers and is configured for reciprocation of the complementary lid $L_{1-4}$ between an open position and a closed position with respect to the receptacle 30.

In yet another exemplary embodiment, a method of separately disposing of medical waste of different types in respective containers is provided. The method comprises the step of actuating a first foot pedal $F_1$, $F_{102}$ of a frame assembly 20 to open a lid $L_1$, $L_{102}$ of a first container, thereby providing access to an interior of a receptacle 30 of the first container. A first type of medical waste is deposited in the receptacle 30 of the first container. A second foot pedal $F_2$, $F_{102}$ of the frame assembly 20 is actuated to open a lid $L_2$, $L_{102}$ of a second container, thereby providing access to an interior of a receptacle 30 of the second container. A second type of medical waste is deposited in the receptacle 30 of the second container.

In still another exemplary embodiment, a method of configuring a plurality of containers for disposing of medical waste of different types in the respective containers is provided. The method comprises the step of positioning a receptacle 30 of each container on a frame assembly 20 at an angle N in a range from about 10 to about 20 degrees from a vertical axis. The lids $L_{1-4}$ of the containers are positioned on the frame assembly 20 for pivotal movement with respect to the complementary receptacles 30, whereby the lids $L_{1-4}$ of the containers are each operable with respective foot pedals $F_{1-4}$.

Referring now to FIGS. 1-4, a multiple container cart assembly embodying exemplary aspects of this invention is generally designated by the numeral "10." The multiple container cart assembly 10, 10' includes a transportable cart assembly 20 and four container assemblies that are mounted onto the cart assembly 20. Each container assembly includes a receptacle or container 30 that is configured to store waste and a pivotable lid $L_{1-4}$. If so desired, the different containers 30 are intended to accept different waste matter, such as medical waste, general waste, recyclables, laundry, etc. That is to say, if so desired, each container may hold a different type of waste or contaminated matter.

Figure 2:
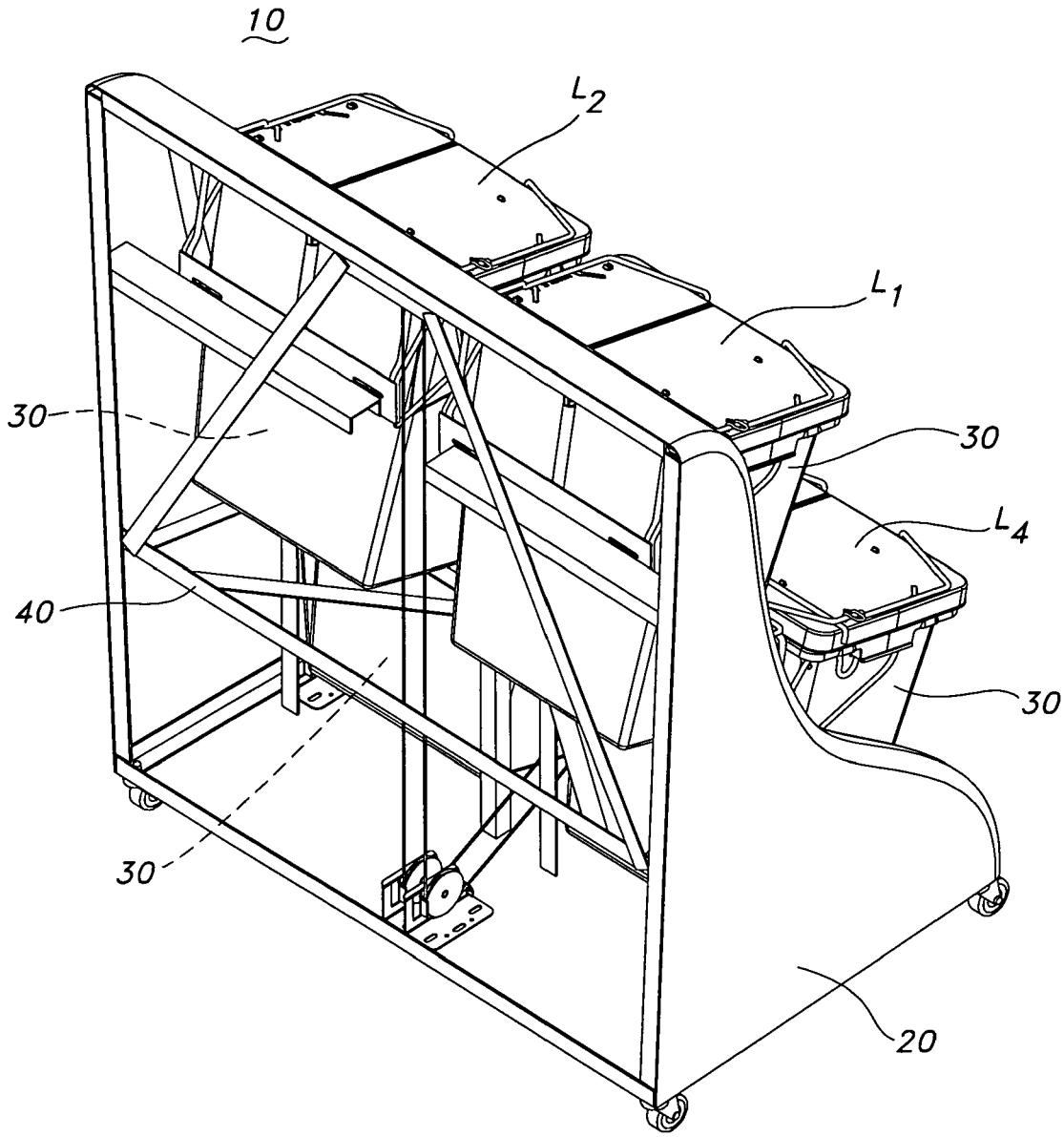
FIG. 2 is a perspective view from the top left of the assembly of FIG. 1.
Figure 3:
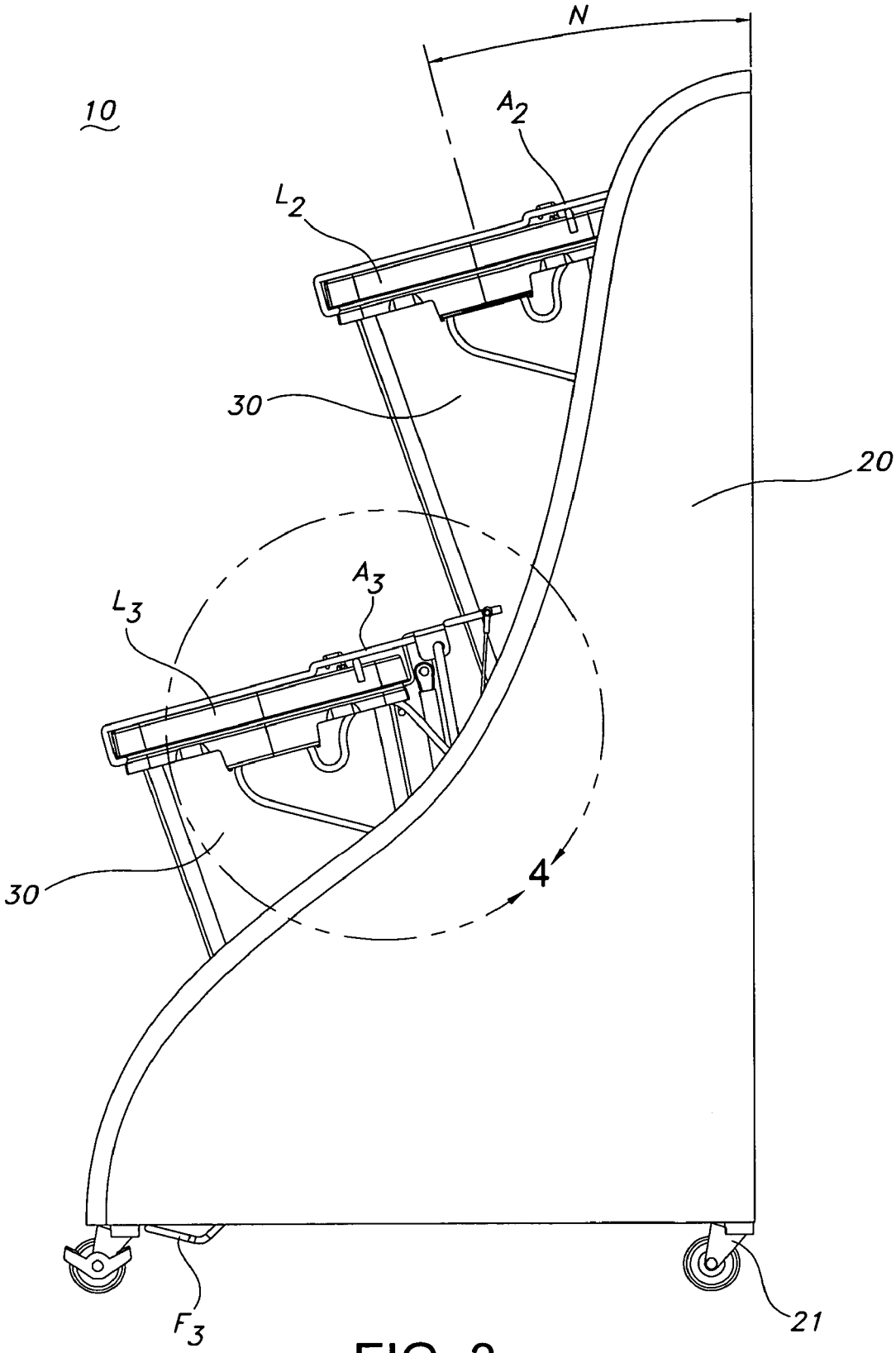
FIG. 3 is an elevation view from the right side of the assembly of FIG. 1.

The multiple container cart assembly 10' illustrated in FIG. 1 shows one lid $L_{1'}$ in an open position and foot pedal $F_{1'}$ in a depressed position. The remaining lids are illustrated in a closed position. The multiple container cart assembly 10 illustrated in FIGS. 2 and 3 show all lids $L_{1-4}$ in a closed position. In an open position of the lid, the container assembly is configured to receive waste. In a closed position of the lid, the container assembly is not configured to receive waste. Although not illustrated herein, a locking device may be utilized to restrict access to any of the containers.

Briefly referring to the overall operation of assembly 10, the lids $L_{1-4}$ of the containers are initially in a closed position as shown in FIGS. 2 and 3. To insert refuse or any other object into any one of the containers, the user depresses an appropriate foot pedal $F_{1-4}$ thereby pivoting the pivoting arm assembly $A_{1-4}$ and corresponding lid $L_{1-4}$ to an open position. The user deposits the refuse into the open container and releases the foot pedal $F_{1-4}$. Thereafter, the lid pivots to a closed position, by virtue of the weight of the lid (aided or unaided by additional biasing means such as a spring or a weight), and the foot pedal naturally returns to its initial position.

It should be understood that foot pedal $F_1$ is indirectly connected to pivoting arm assembly $A_1$ that engages lid $L_1$. Similarly, foot pedal $F_2$ is indirectly connected to pivoting arm assembly $A_2$ that engages lid $L_2$, and so forth. The kinematic relationship between the foot pedal and its corresponding pivoting arm will be described in further detail later.

The multiple container cart assembly 10, 10' is commonly employed in a hospital or medical office setting. In such a setting it is desirable to maximize the capacity of the cart assembly to accept more waste, and, yet conversely, it is also desirable to minimize the size of the overall assembly so that the assembly consumes minimal floor space in the hospital. Furthermore, it is also desirable to position the containers such that they are user-accessible (i.e., in reach) so that the user may deposit refuse into the appropriate containers, replace a filled container with an empty container, or replace a refuse bag with minimal effort. This is especially advantageous in an environment, such as a medical environment, in which medical waste must be sorted for appropriate disposal.

The containers on the top row are also positioned so as to provide clearance for the rotation of the container lids on the bottom row. This allows free usage of the various containers without physical interference among their moving components.

It has been discovered that it is advantageous to position the entire body of the container 30 onto the cart assembly 20 at an angle "N" (see FIG. 3) relative to a vertical axis to satisfy the aforementioned space constraints such as those found in a hospital setting. In one exemplary embodiment the angle N is about 10 to about 20 degrees. In another exemplary embodiment, the angle N is preferably about 15 degrees. Although all of the containers 30 are positioned at the angle N, as illustrated in the figures, the containers may be positioned at different angles relative to one another. Furthermore, although the entire body of receptacle 30 is angled with respect to a vertical axis in this embodiment, in another exemplary embodiment not illustrated herein, only the top of the container body is angled with respect to a vertical axis.

The height, the width, and the length of the assembly can be selected based on the capacity, quantity, and shape of the containers that the assembly accommodates because the capacity, quantity, and/or shape of the containers can vary widely in a single assembly or from one assembly to another.

Figure 4:
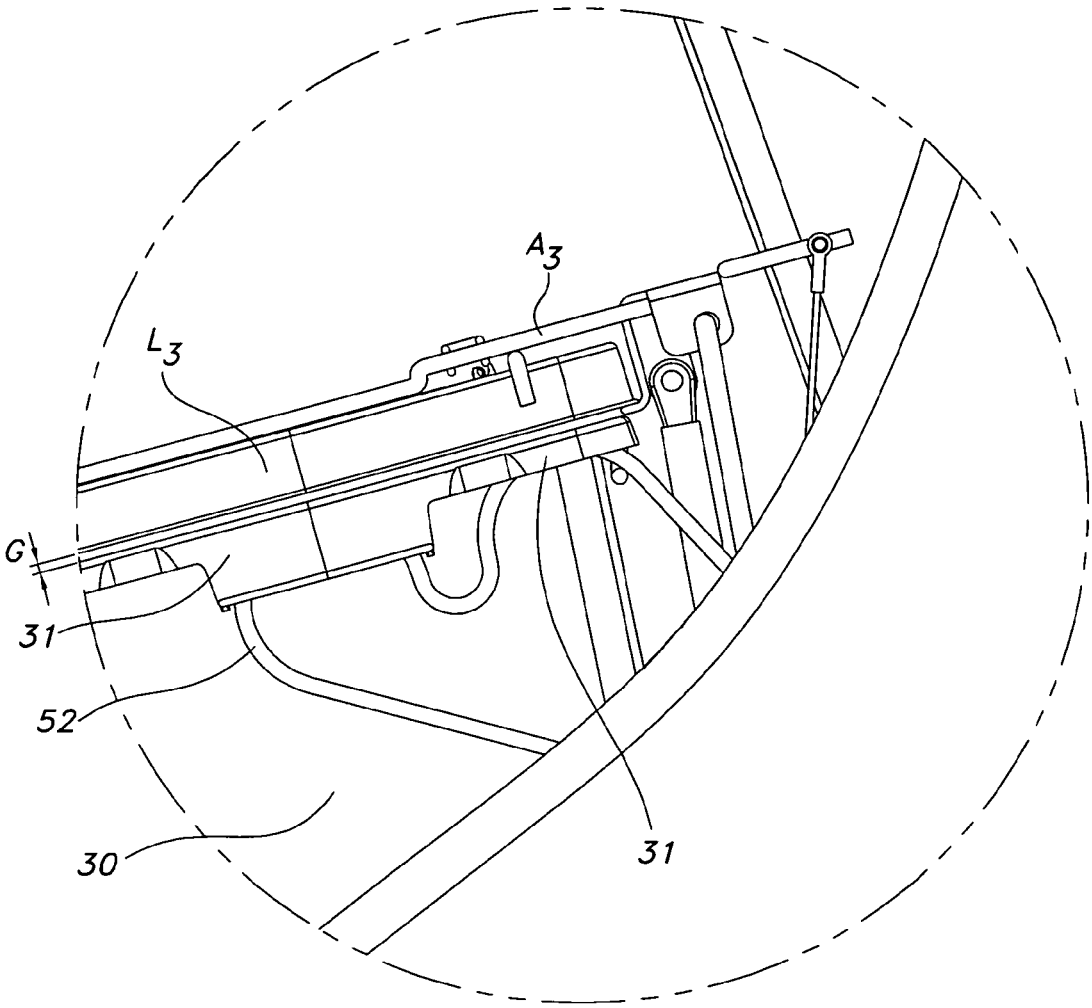
FIG. 4 is a detail view of a support member and a container illustrated in FIG. 3.

Referring specifically to FIG. 4, each container 30 is mounted onto a set of two support arms 52, which are fixedly coupled to the frame (one support arm shown in FIG. 4). More specifically, a mounting portion 31 formed on both sides of each container 30 is positioned to receive the mounting segments 63 of the support arms 52 (see FIG. 8). In addition to operating as a mount for the container, mounting portion 31 is also provided as a handle for the user to grasp upon removing and/or installing the container or a lip of the receptacle component of the container. Another mounting portion 131, which is identical to mounting portion 31, is more clearly illustrated in FIG. 13. The mounting portion 31 merely rests on the support arms 52, as the support arms 52 and the container are not fastened together. Thus, the container 30 is readily removable from the cart assembly 20.

The mounting portion 31 may also be in the form of an aperture, lip, shoulder or protrusion, for example, formed on the body of the container. Although one mounting arrangement is illustrated in the figures, it should be understood that a number of other mounting arrangements are contemplated. For example, the container may be fixedly mounted to the support arm 52 with a fastener. Moreover, the container may be simply positioned within a cavity 23 of the cart body or directly coupled to the cart body 24 (the cart body 24 is exclusively illustrated in FIG. 11). It will be appreciated that the container may be positioned at the cart assembly in a wide variety of manners and can be releasably or fixedly mounted to a portion, such as a frame portion, in any number of ways, depending upon the preference of the user, the configuration of the container(s), and other factors.

The container 30 may be composed of a rubber or plastic material and formed by any forming process, such as rotational molding, blow molding or injection molding. Alternatively, the container body may be composed of a metallic material that is substantially puncture resistant. The container 30 and lid $L_{1-4}$ may also be any commonly available waste container such as those comprised of a receptacle and lid combination.

As illustrated in FIG. 4, the lid $L_{1-4}$ is not directly coupled to the receptacle 30. A gap "G" optionally exists between the Lid $L_{1-4}$ and the container 30 to accommodate the lid retaining segments 56 and 57 (See FIG. 8) of the pivoting arm assembly $A_{1-4}$. However, in another exemplary embodiment, the lid is pivotably coupled to either the container 30 or the cart shell 24.

Referring now to FIGS. 5-8, the cart assembly 20 of this exemplary embodiment generally comprises a frame 40, four linkage assemblies $K_{1-4}$ mounted to the frame, and a hollow cart shell 24 (omitted for clarity in FIGS. 5-8) positioned to conceal a portion of the frame 40.

The frame 40 generally includes the base plate 22 and an arrangement of rigid bars and beams fastened or welded together. More particularly, the frame includes vertical members 42 fixedly mounted to the base plate 22 and cross members 41 fixedly mounted to the vertical members 42. The cross members 41 are positioned to stabilize, support and reinforce the entire frame assembly. A C-beam 43 is fixedly mounted to rear vertical members 42, and a bracket 44 is mounted to front vertical members 42 (best shown in FIG. 6).

Referring still to the frame assembly 40, two rectangular mounting brackets 54 are fastened or welded to the C-beam 43 to support the top row of containers 30, and two mounting brackets 54 are fastened or welded to the C-beam 43 to support the top row of containers 30. Four sets of support arms 52 are welded or fastened to the front side of the respective mounting brackets 54. As mentioned previously, each container 30 is positioned on a complimentary set of support arms 52. A support rod 62 extending between each set of support arms 52 and fastened thereto is provided to reinforce the support arms 52.

Figure 9:
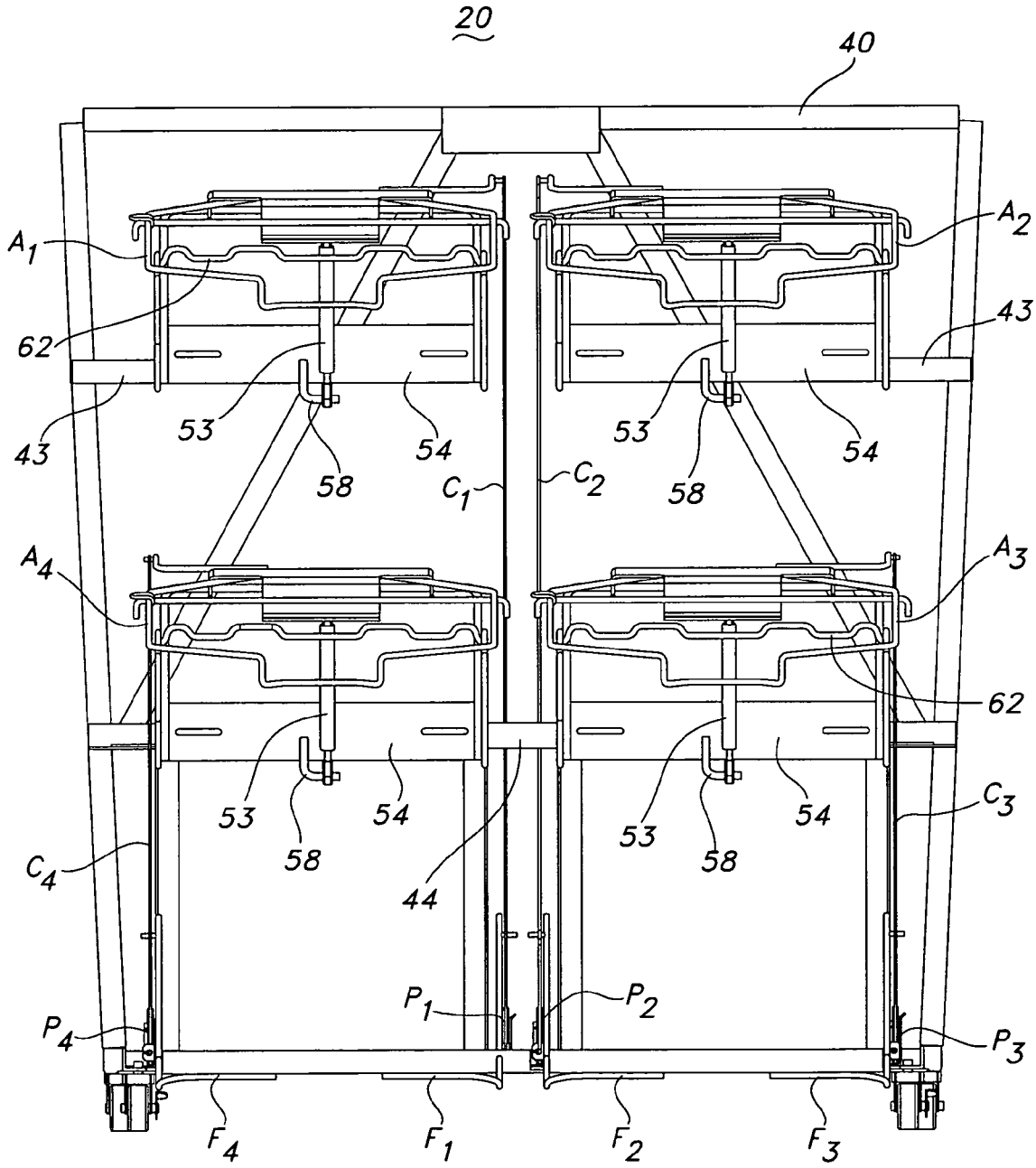
FIG. 9 is a front elevation view of the cart frame of FIG. 5.

Four sets of support rods 61 (best shown in FIG. 6) are welded or fastened to the front side of respective mounting brackets 54. It should be understood that the support rods 61 do not rotate or translate, rather, the support rods are fixed in position and the arm assembly (described in further detail below) pivots about them. A support rod 58 is welded or fastened to the front side of the mounting brackets 54, as best illustrated in FIG. 9. The purpose of the support rod 58 will be described in further detail later with respect to the linkages.

An optional set of wheels or casters 21 are pivotably mounted to the underside of the base plate 22. Although not shown, an optional handle or other apparatus mounted to the exterior of the cart shell 24 or frame assembly 40 may be provided to guide the motive assembly 10. It is envisioned that a motor or other device (not shown) could be linked to the wheels to provide automated motion.

A pedal bracket 45 and a set of four pulleys $P_{1-4}$ are fixedly mounted to the top side of the base plate 22, the purpose of which will be described in further detail later with reference to the linkages.

The frame assembly 40 components may have any cross sectional shape, as they are not limited to the illustrations, and may be composed of any common rigid material, such as steel or aluminum, to effectively support the containers 30. The frame 40 is not limited to the illustration shown, as the bars and the beams may be arranged in many different configurations to sufficiently support the containers and the cart shell 24.

Figure 5:
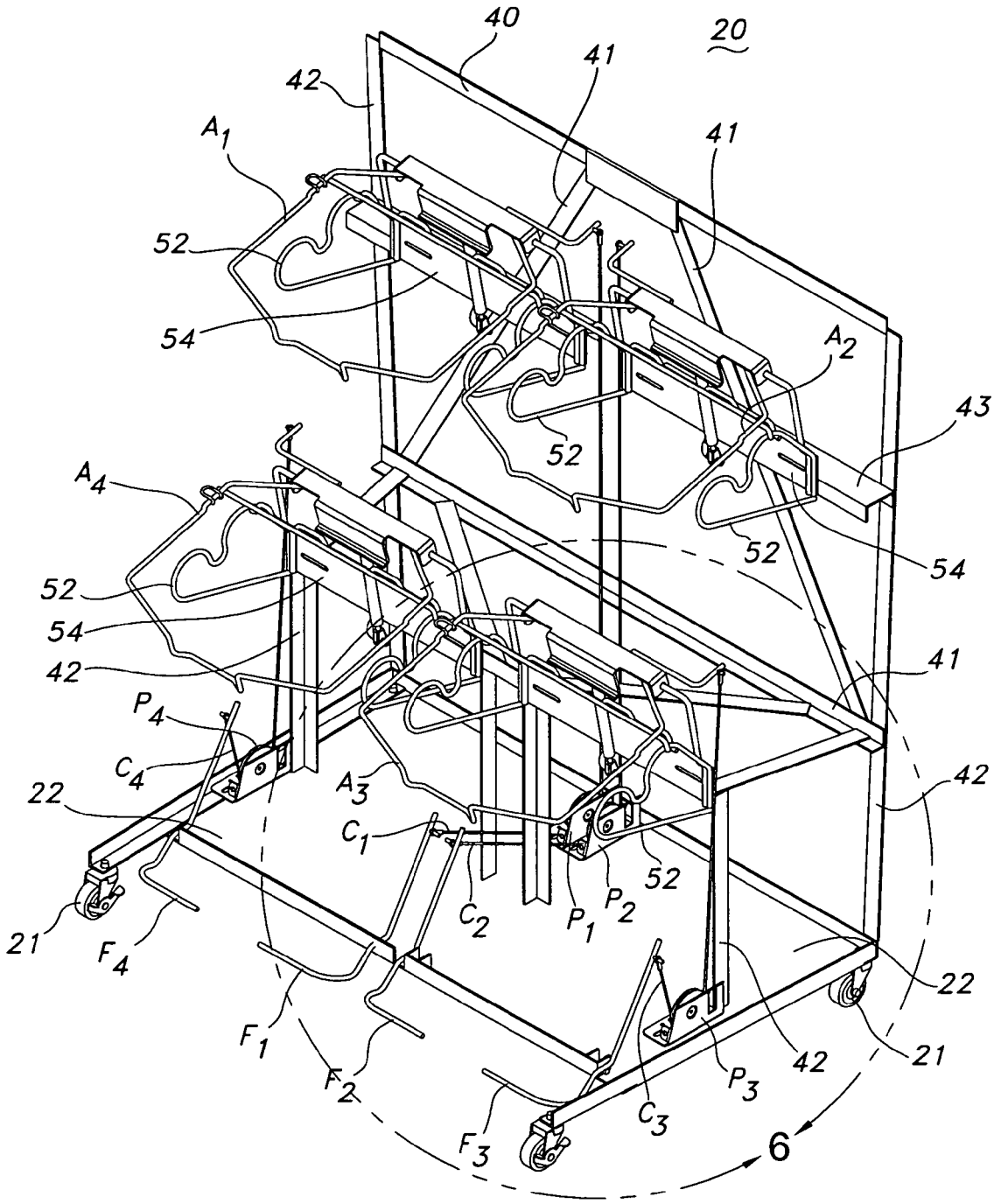
FIG. 5 is a perspective view from the top right of an exemplary embodiment of a cart frame of the assembly illustrated in FIG. 1, with the cart shell omitted to reveal internal details.
Figure 6:
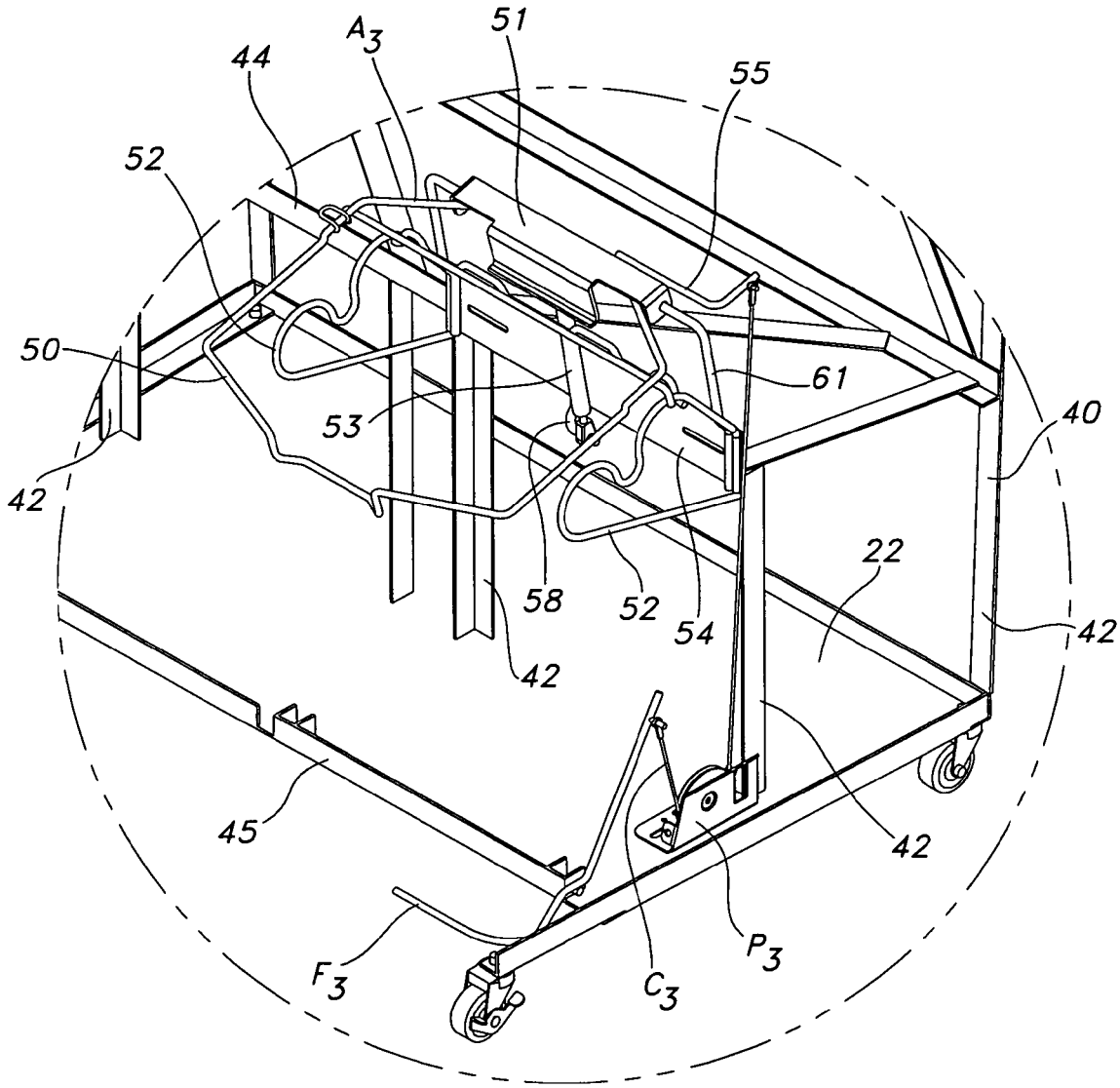
FIG. 6 is a detail view of a linkage illustrated in FIG. 5.
Figure 7:
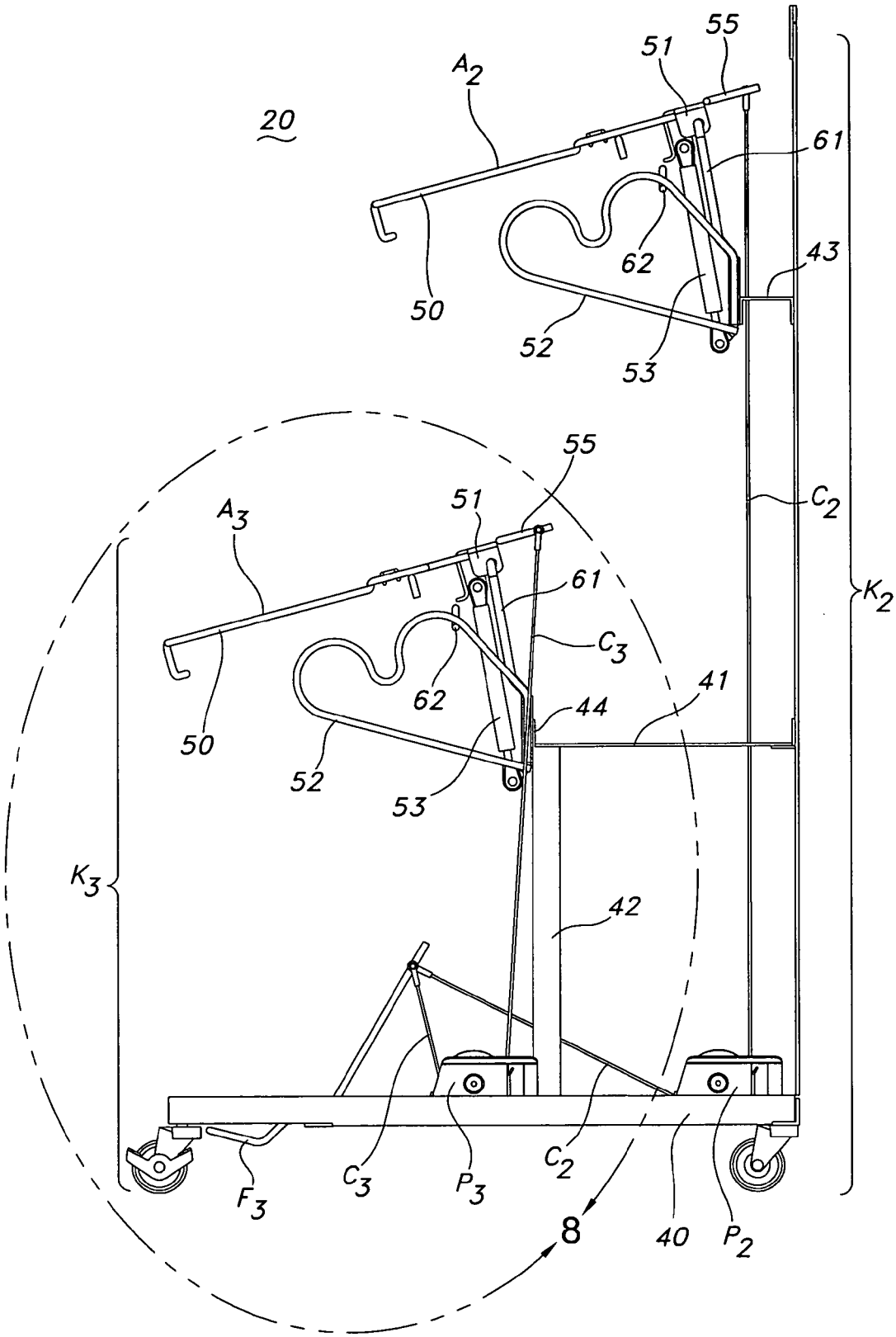
FIG. 7 is an elevation view from the right side of the cart frame of FIG. 5.

The cart assembly 20 of the exemplary embodiment illustrated in FIGS. 5, 7 and 9 includes four separate linkages $K_{1-4}$ mounted to the frame 40. Each linkage assembly of this exemplary embodiment includes a foot pedal $F_{1-4}$ pivotably coupled to one end of a cable $C_{1-4}$ and a pivoting arm assembly $A_{1-4}$ pivotably coupled to an opposing end of the cable $C_{1-4}$, respectively. It should be appreciated that any number of linkage assemblies $K_{1-N}$ can be employed according to this exemplary embodiment, each includes a foot pedal $F_{1-N}$ pivotably coupled to one end of a cable $C_{1-N}$ and a pivoting arm assembly $A_{1-N}$ pivotably coupled to an opposing end of the cable $C_{1-N}$, respectively. Inasmuch as the separate linkages $K_{1-4}$ are substantially equivalent in structure and operation, linkage $K_3$ will be described in detail with the understanding that like reference numerals will be used for like structure in each linkage. Accordingly, linkage $K_3$ is singularly illustrated in FIGS. 6, 8 and 10 (linkages $K_{1,2,4}$ have been omitted for brevity).

Figure 8:
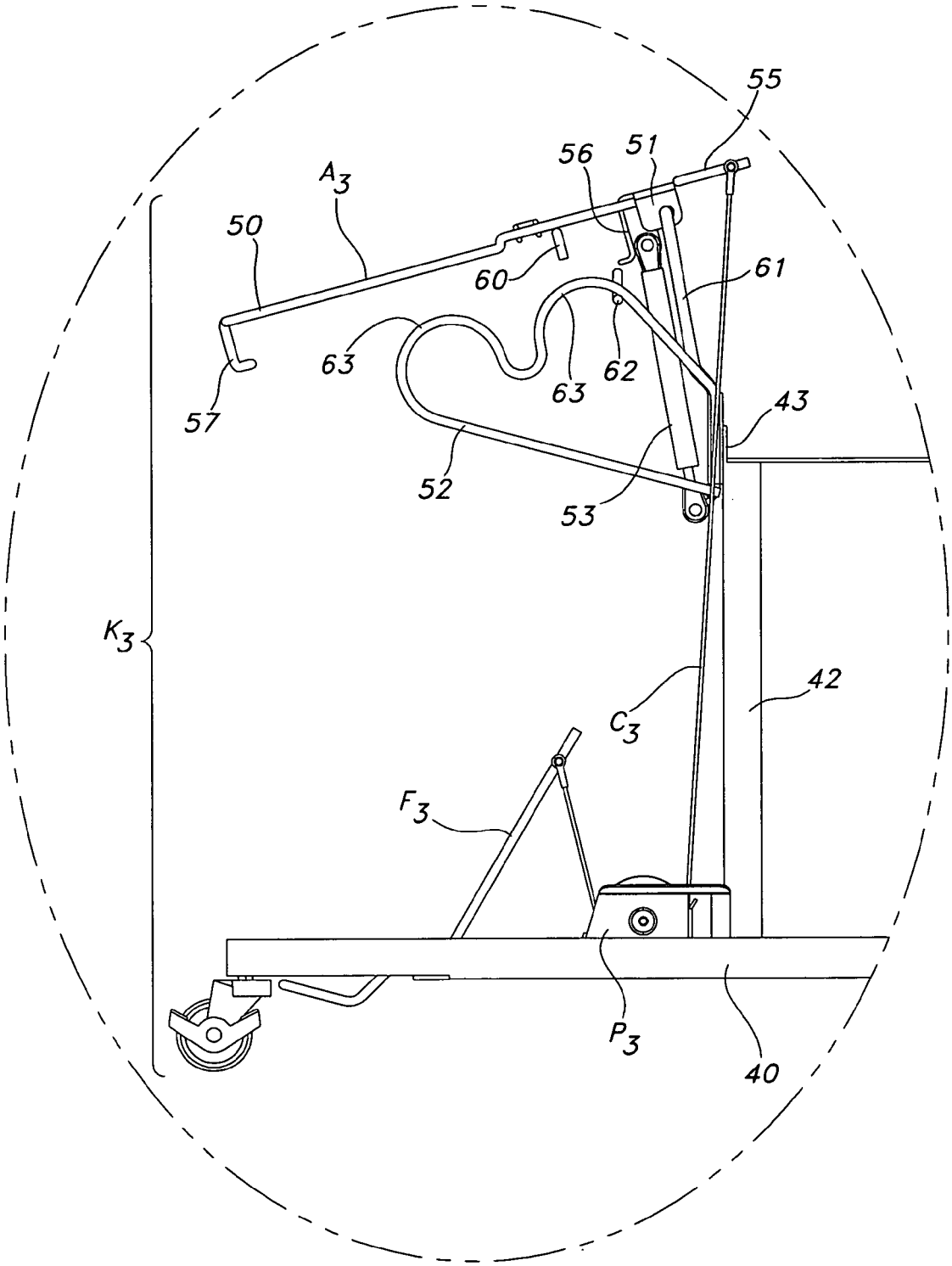
FIG. 8 is a detail view of a linkage illustrated in FIG. 7.
Figure 10:
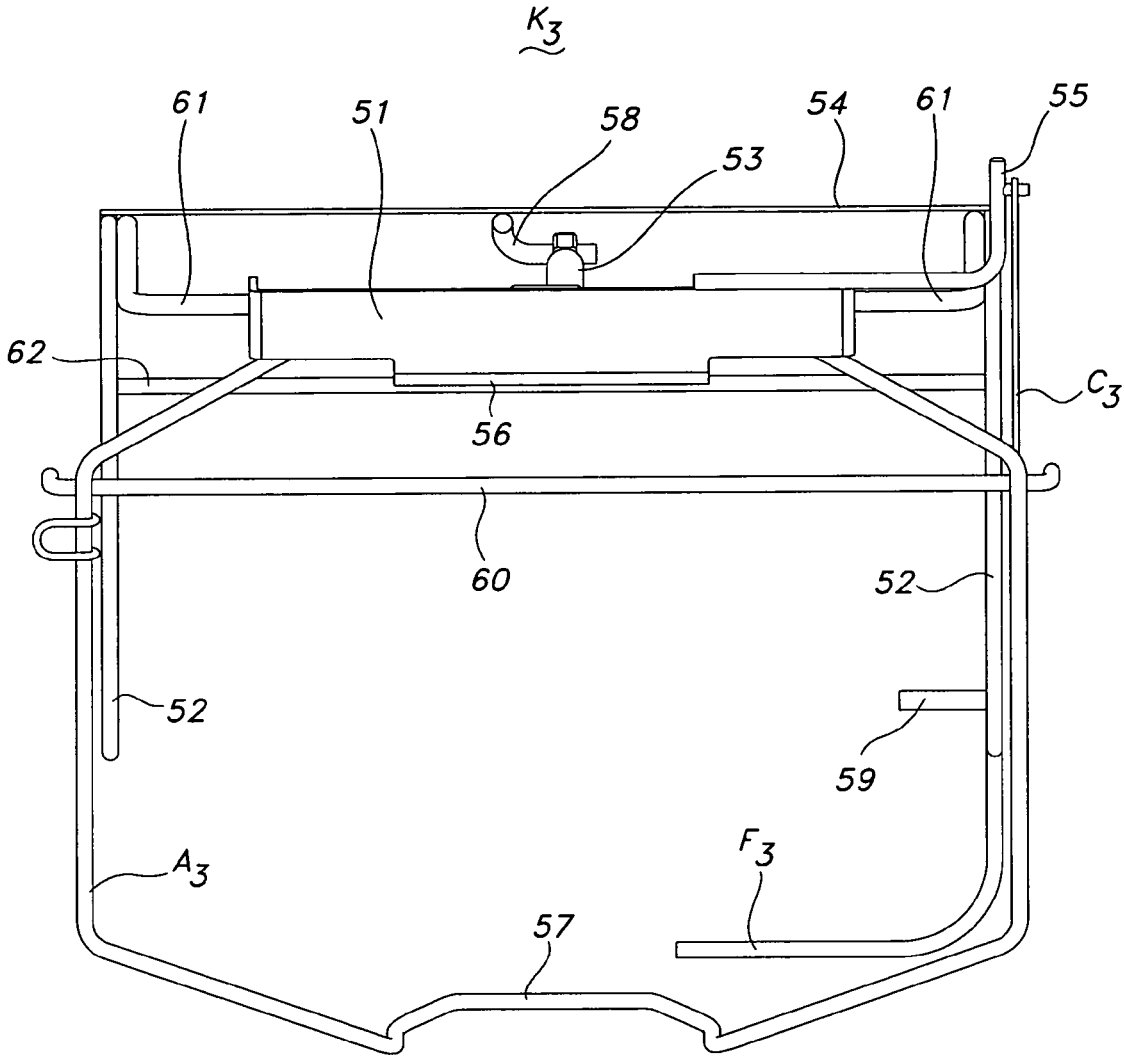
FIG. 10 is a top plan view of an exemplary embodiment of a linkage support arm and mounting bracket illustrated in FIG. 5.

Referring now to the linkage assembly $K_3$ illustrated in FIGS. 6, 8 and 10, the foot pedal $F_3$ pivots about a rod 59. The rod 59 extends into an aperture defined in a pedal bracket 45, as best illustrated in FIG. 6. A nut, pin or other fastener (not shown) captivates the rod 59 within the pedal bracket aperture, although it should be understood that the fastener permits rotation of rod 59 about the aperture. The cable $C_3$ is pivotably or otherwise coupled to an end portion of the pivoting foot pedal $F_3$.

The cable is thereafter routed through a pulley $P_3$ and is pivotably or otherwise coupled to a cable connecting arm 55 of the pivoting arm assembly $A_3$. The pivoting arm assembly comprises a bracket 51, a wire-form pivoting arm 50 fixedly mounted to the underside of the bracket 51, and the cable connecting arm 55 which is fastened or welded to the rear side of the bracket 51. The bracket 51 includes an aperture through which a support rod 61 is inserted, such that the bracket 51 pivots about the fixed support rod 61.

As best illustrated in FIG. 8, the bracket 51 includes a lid retaining segment 56 which engages the rear end of a lid. Similarly, the pivoting arm 50 includes a lid retaining segment 57 which engages the front end of the lid. Another lid retaining bracket 60 fixedly mounted to the pivoting arm 50 engages the sides of the lid. In combination, the lid retaining segments 56, 57 and 60 retain the lid in a substantially fixed position, and accordingly, the lid (e.g., $L_3$) pivots along with the pivoting arm assembly $A_3$.

In use, when the foot pedal $F_3$ is depressed (i.e. rotated in a counterclockwise direction when viewed from the right) the foot pedal pulls the cable $C_3$ along the pulley $P_3$, which in turn rotates the cable connection arm 55 downward in a clockwise direction. The entire pivoting arm assembly $A_3$ and lid (e.g., $L_3$) rotates in the clockwise direction along with the cable connection arm 55.

A dampening element 53 is optionally included to facilitate smooth and controlled rotation of the lid. One end of the dampening element is pivotably coupled to the support rod 58, as best illustrated in FIG. 9, and the other end of the dampening element 53 is pivotably coupled to the rear side of bracket 51, as best illustrated in FIG. 8. The dampening element 53 may be pivotably mounted to both bracket 51 and support rod 58 so that it is permitted to pivot along with the pivoting arm assembly $A_3$. The dampening element of this exemplary embodiment may be any commonly available spring or strut known in the art.

The pivoting arm assemblies $A_{1-4}$ and foot pedals $F_{1-4}$ may have any cross-sectional shape, as they are not limited to those in the illustrations, and may be composed of any common rigid material, such as steel or aluminum. The cables $C_{1-4}$ may be composed of any flexible, non-yielding material having a sufficient tensile strength for its intended purpose.

Figure 11:
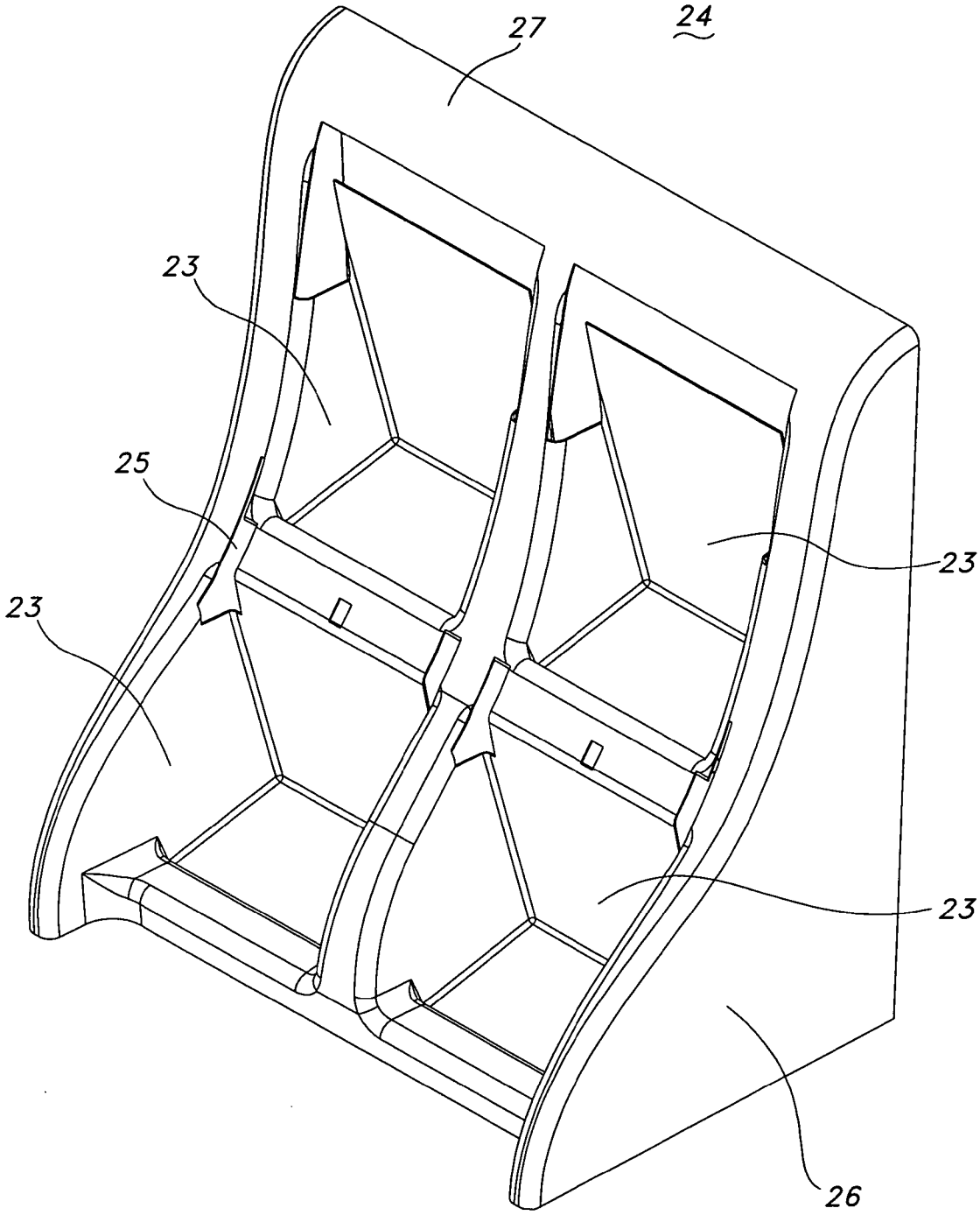
FIG. 11 is a perspective view from the top right of an exemplary embodiment of a cart shell illustrated in FIG. 1.

An exemplary embodiment of a cart shell 24 is illustrated in FIG. 11. The cart shell comprises four cavities 23 positioned to accommodate the container bodies 30. Each cavity includes an aperture(s) 25 to accommodate the respective linkages $K_{1-4}$. The cart shell embodiment illustrated herein does not cover or conceal the bottom side and rear side of the cart assembly 10. However, in another exemplary embodiment, the cart shell may cover either the bottom side or rear side of the cart assembly 10 if so desired. The cart body may be formed by a forming process, such as rotational molding, blow molding or injection molding. Alternatively, the cart shell may be composed of individual components fastened together.

The design of the side walls 26 and sloping walls 27 are ornamental features of the cart shell 24 illustrated in FIG. 11. The cart shell can have a wide variety of ornamental shapes and configurations, including a variety of proportions, thicknesses, cross-sections, and curvatures.

Figure 12:
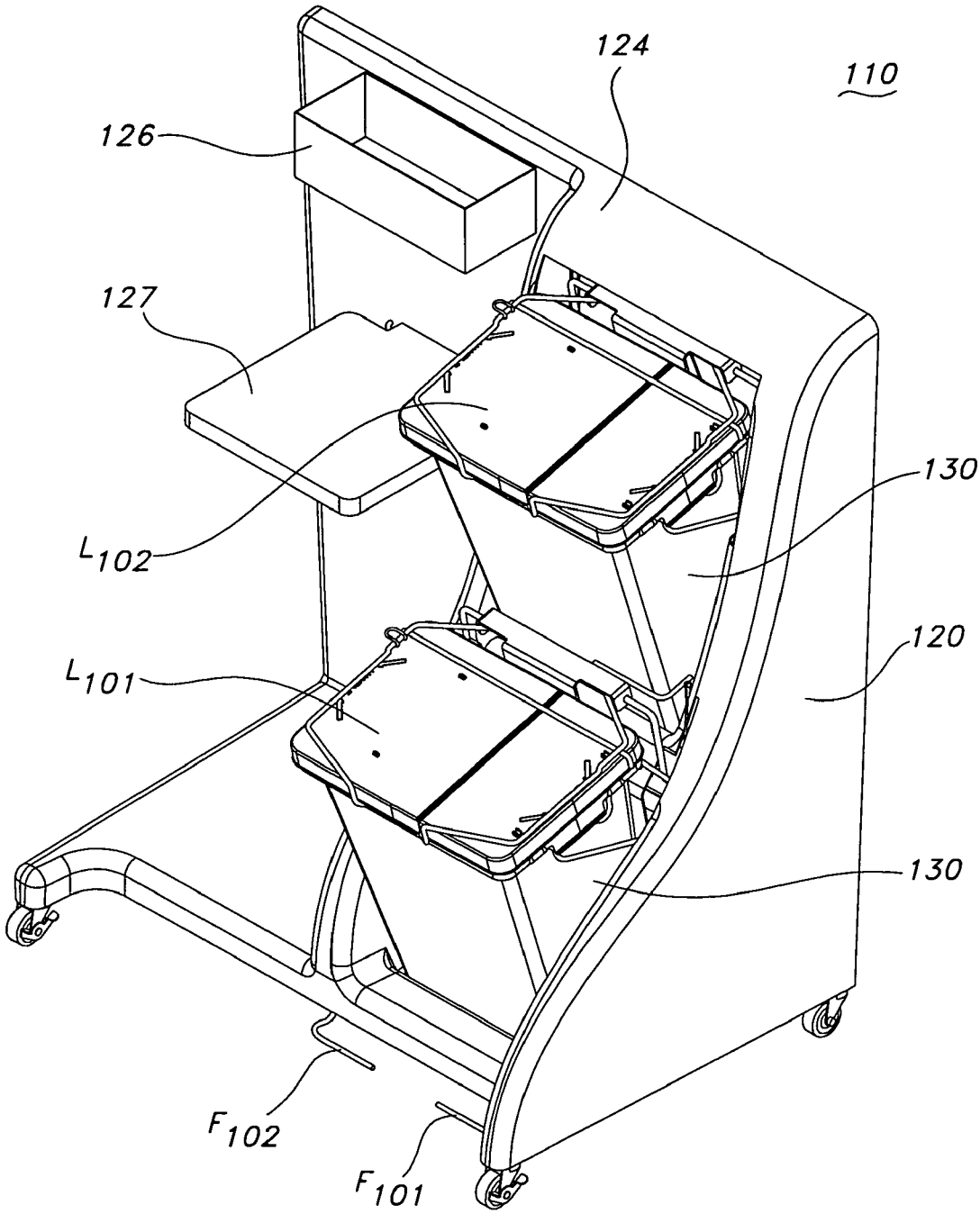
FIG. 12 is a perspective view from the top right of another exemplary embodiment of an assembly including a cart and two containers mounted thereon according to aspects of this invention.
Figure 13:
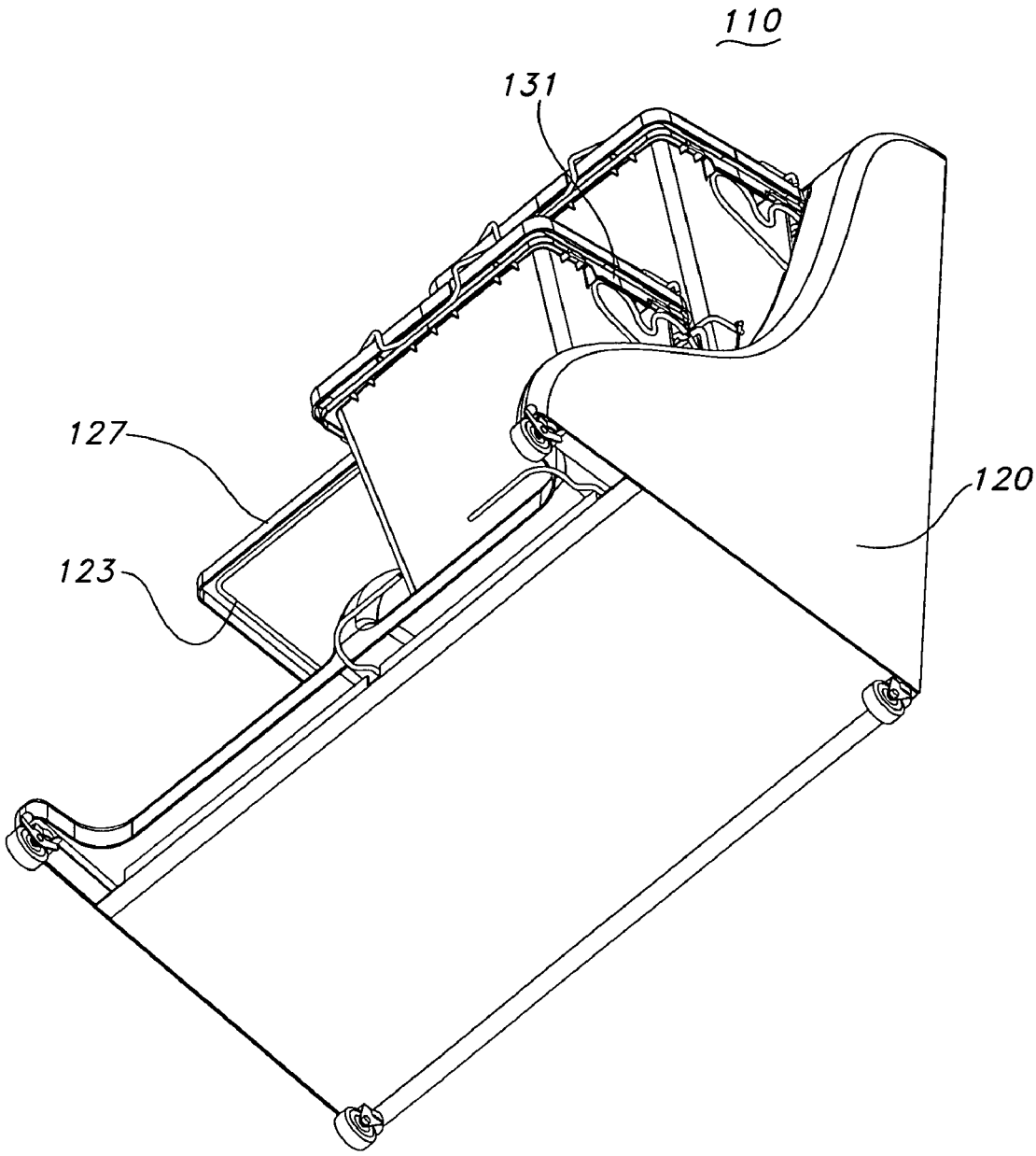
FIG. 13 is a perspective view from the bottom right of the assembly of FIG. 12.

Another exemplary embodiment of a multiple container cart assembly 110 is illustrated in FIGS. 12 and 13. The multiple container cart assembly 110 generally includes two vertically adjacent containers 130 having lids $L_{101}$ and $L_{102}$ that are mounted onto a cart assembly 120. Accordingly, similar to the prior exemplary embodiment, two foot pedals $F_{101}$ and $F_{102}$ are provided to pivot the lids $L_{101}$ and $L_{102}$, respectively, between an open and a closed position (as shown).

Since the cart assembly 110 includes two containers 30, the cart shell 124 differs from the cart shell 24 illustrated in the previous embodiment. That is, cart shell 124 includes two cavities instead of four cavities to accommodate the containers. An accessory tray 126 is optionally mounted to either the cart frame or the cart shell 124. The tray 126 may be a storage bin to stow a supply of gloves, for example, or any other commonly used item.

As best illustrated in FIG. 13, a support rod 123 is fixedly mounted to either the frame or the cart shell 124. In practice, a waste bag (not shown) is coupled or suspended from the rod 123 to accept medical or other waste. A lid 127 is either hingedly coupled to the rod 123, the frame or the cart shell 124, to pivot between an open position and a closed position (as shown). In the open position of lid 127, a user may deposit waste into the bag. Unlike lids $L_{101}$ and $L_{102}$, a foot pedal and corresponding linkage is not coupled to lid 127, thus, in use, the user pivots the lid between an open position and a closed position by hand. However, it is contemplated that a linkage similar to the previously described linkages may be incorporated to engage lid 127.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

Furthermore, it should be understood that the structure of the frame 40 and linkages $K_{1-4}$ may deviate from the illustrations, as numerous configurations of both the frame 40 and linkages $K_{1-4}$ are contemplated. Although four containers 30 are illustrated herein, the multiple container cart assembly 10 may include any number of containers. The containers may be of any adequate size to achieve the same purpose and may be positioned in any orientation depending upon the needs of the user. Furthermore, although the containers are positioned on a single side of the cart, the containers may be positioned on opposite sides of the cart.

What is claimed:

1. A medical refuse receptacle system comprising:

a frame;

a plurality of refuse containers supported by said frame, each of said refuse containers having a receptacle and a complementary lid reciprocally movable with respect to said receptacle, wherein said receptacle of each of said containers is supported by said frame and is disposed at an angle in a range from about 10 to about 20 degrees from a vertical axis of the frame, each receptacle dimensioned for accommodating medical waste;

a plurality of linkages associated with said frame, whereby each linkage is coupled to said complementary lid of one of said containers and is configured for reciprocation of said complementary lid between an open position and a closed position with respect to said receptacle; and an outer shell positioned over at least a portion of said frame.

2. The system of claim 1 wherein at least one of said linkages includes a foot pedal pivotably coupled to a base portion of said frame for pivotal motion with respect to said frame.

3. The system of claim 2, each of said linkages further comprising an arm mounted for pivotal movement with respect to said frame and engaging said lid of said container, wherein pivotal movement of said foot pedal with respect to said frame pivots said arm with respect to said frame and moves said lid between said open and said closed positions.

4. The system of claim 3, each of said linkages further comprising a cable coupling said foot pedal to said arm.

5. The system of claim 4 further comprising at least one pulley mounted to said frame, wherein a position of said pulley at least partially defines the path of said cable between said foot pedal and said arm.

6. The system of claim 2, wherein at least one of said linkages includes a damping element configured to dampen the pivotal reciprocation of said arm.

7. The system of claim 2, wherein each said receptacle is secured to the frame in fixed relation therewith at the angle ranging from about 10 degrees to about 20 degrees.

8. The system of claim 2 including a plurality of foot pedals coupled to said frame, each said foot pedal operatively connected to a respective linkage and complementary lid, said foot pedals movable independent of each other to selectively move said complementary lid between said open position and said closed position.

9. The system of claim 1, wherein said containers are medical waste containers adapted to contain medical waste for disposal.

10. The system of claim 1, said outer shell being rotationally molded.

11. The system of claim 1 further comprising a plurality of supports coupled to said frame, wherein each of said supports is positioned to at least partially support one of said containers.

12. The system of claim 11 wherein each of said refuse containers includes a mounting portion to accommodate said support.

13. The system of claim 12, said mounting portion being formed in said receptacle of said container and is selected from a group consisting of a flange, an aperture, a slot and a protrusion.

14. The system of claim 1, wherein said receptacle of each of said containers is disposed at an angle of about 15 degrees from a vertical axis.

15. A medical refuse receptacle assembly configured for use with a plurality of refuse containers each having a receptacle dimensioned for accommodating medical refuse and a complementary lid reciprocally movable with respect to the receptacle, the refuse receptacle assembly comprising:

a frame configured to support the receptacle of each of the containers at an angle in a range from about 10 to about 20 degrees from a vertical axis of the frame;

a plurality of linkages associated with said frame, whereby each linkage is configured to be coupled to the complementary lid of one of the containers and is configured for reciprocation of the complementary lid between an open position and a closed position with respect to the receptacle; and an outer shell positioned over at least a portion of said frame.

16. The refuse receptacle assembly of claim 15 wherein at least one of said linkages includes a foot pedal pivotably coupled to a base portion of said frame for pivotal motion with respect to said frame.

17. The refuse receptacle assembly of claim 16, each of said linkages further comprising an arm mounted for pivotal movement with respect to said frame and configured to engage a complementary lid of one of the containers, wherein pivotal movement of said foot pedal with respect to said frame pivots said arm with respect to said frame and is configured to move the complementary lid between open and closed positions with respect to the receptacle.

18. The refuse receptacle assembly of claim 17, each of said linkages further comprising a cable coupling said foot pedal to said arm.

19. The refuse receptacle assembly of claim 18 further comprising at least one pulley mounted to said frame, wherein a position of said pulley at least partially defines the path of said cable between said foot pedal and said arm.

20. The system of claim 15, wherein each said receptacle is secured to the frame in fixed relation therewith at the angle ranging from about 10 degrees to about 20 degrees.

21. The system of claim 15 including a plurality of foot pedals coupled to said frame, each said foot pedal operatively connected to a respective linkage and complementary lid, said foot pedals movable independent of each other to selectively move said complementary lid between said open position and said closed position.

22. A medical refuse receptacle system, which comprises:

a frame defining a vertical axis;

a plurality of refuse containers supported by said frame, each of said refuse containers having a receptacle and an associated lid reciprocally movable relative to said receptacle between open and closed positions, at least one of said receptacles being disposed at an angle in a range from about 10 to about 20 degrees relative to said vertical axis, each receptacle dimensioned and configured for reception of medical waste;

a foot pedal operatively connected to each lid of said refuse containers, said foot pedals adapted to move independently of each other, each said foot pedal mounted for movement relative to said frame to move a respective lid between said open and closed positions;

a plurality of linkages associated with said frame, whereby each linkage is coupled to said lid of one of said containers and is configured for reciprocation of said lid between said open position and said closed position; and an outer shell positioned over at least a portion of said frame.

* * * * *